US005528833A

United States Patent [19]

Sakuma

[11] Patent Number: 5,528,833

[45] Date of Patent: Jun. 25, 1996

[54] SCISSORS WITH CERAMIC COATED REPLACEABLE CUTTING BLADES

[75] Inventor: Shuji Sakuma, Tokyo, Japan

[73] Assignee: Kabushiki Kaisha Sangi, Tokyo, Japan

[21] Appl. No.: 229,537

[22] Filed: Apr. 19, 1994

[51] Int. Cl.[6] ..... B26B 13/04

[52] U.S. Cl. ..... 30/260; 30/254; 30/350; 76/104.1

[58] Field of Search ..... 30/260, 346.54, 30/350, 349; 76/101.1, 104.1, DIG. 8

[56] References Cited

U.S. PATENT DOCUMENTS 4,592,141 6/1986 Levine ..... 30/350

5,086,563 2/1992 Sakuma et al. .

5,142,785 9/1992 Gerwal et al. ..... 76/DIG. 8

FOREIGN PATENT DOCUMENTS 56-3152 1/1981 Japan ..... 30/350

*Primary Examiner*—Douglas D. Watts

*Attorney, Agent, or Firm*—Finnegan, Henderson, Farabow, Garrett & Dunner

[57] ABSTRACT

Scissors having a pair of blades that are pivotally connected to each other, each blade having a handle portion and a cutting portion detachably connected thereto. The cutting portion of each blade has a ceramic coating on a cutting edge thereof to increase its cutting life and to provide long lasting sharpness. Depending upon the component used in the coating process, the ceramic coating can be colored.

5 Claims, 1 Drawing Sheet

SCISSORS WITH CERAMIC COATED REPLACEABLE CUTTING BLADES

BACKGROUND OF THE INVENTION

1. Field of the Invention

This invention relates to scissors having cutting blades which are replaceable with new cutting blades that have tough ceramic coatings at least on the cutting edges thereof.

2. Description of the Prior Art

Barbers, who make frequent use of scissors, want to use scissors with cutting blades that can be replaced with new cutting blades having sharpened cutting edges thereon to save the time spent resharpening dull cutting edges or the expense of professional people that can grind and sharpen the cutting edges.

This type of the scissors having replaceable cutting blades is disclosed in U.S. Pat. No. 5,086,563 wherein a fixed blade and movable blade are joined by a screw and each blade includes a cutting portion having a cutting edge and a handle portion to which the cutting portion is detachably secured.

In order to improve the sharpness of the scissors, a cutting blade made of a ceramic material is provided. The hardness of the ceramic material makes it possible to provide a cutting blade having a significantly sharper edge. However, the ceramic material is breakable or brittle so that the cutting edges made of the ceramic material are likely to be nicked when used or dropped.

Professional barbers who always use scissors sometimes want to use colored scissors to make a favorable impression on their clients. To satisfy this demand, a colored plating or a synthetic resin coating is applied to the scissors, but it is found that the cutting edges colored by the plating or the resin coating become dulled.

SUMMARY OF THE INVENTION

Accordingly, an object of the present invention is to provide scissors with replaceable cutting blades to solve the foregoing problems encountered in the prior art.

According to the present invention, the foregoing object is achieved by providing scissors with replaceable cutting blades in which a ceramic coating is produced on a metal based edge portion of a cutting blade. Preferably, the ceramic coating produced on the cutting blade is 100Å–5 μm in thickness and colored, for example, such as blue, gold, green or pink. For accomplishing the colored ceramic coating, chemical vapor deposition processes or physical vapor deposition processes are utilized. The coloring processes can also be applied to the handles of the scissors.

In use, cutting blades having a desired length and/or color are detachably secured to handles. When the cutting edges of the cutting blades became dulled, its cutting blades will be removed and new sharpened cutting blades substituted therefor. Of course, the replaced old blades can be ground and sharpened again.

The present invention will be better understood and the other objects and advantages thereof will be more apparent from the following detailed description of preferred embodiments with reference to the accompanying drawings.

DESCRIPTION OF THE PREFERRED EMBODIMENT

Figure 1:
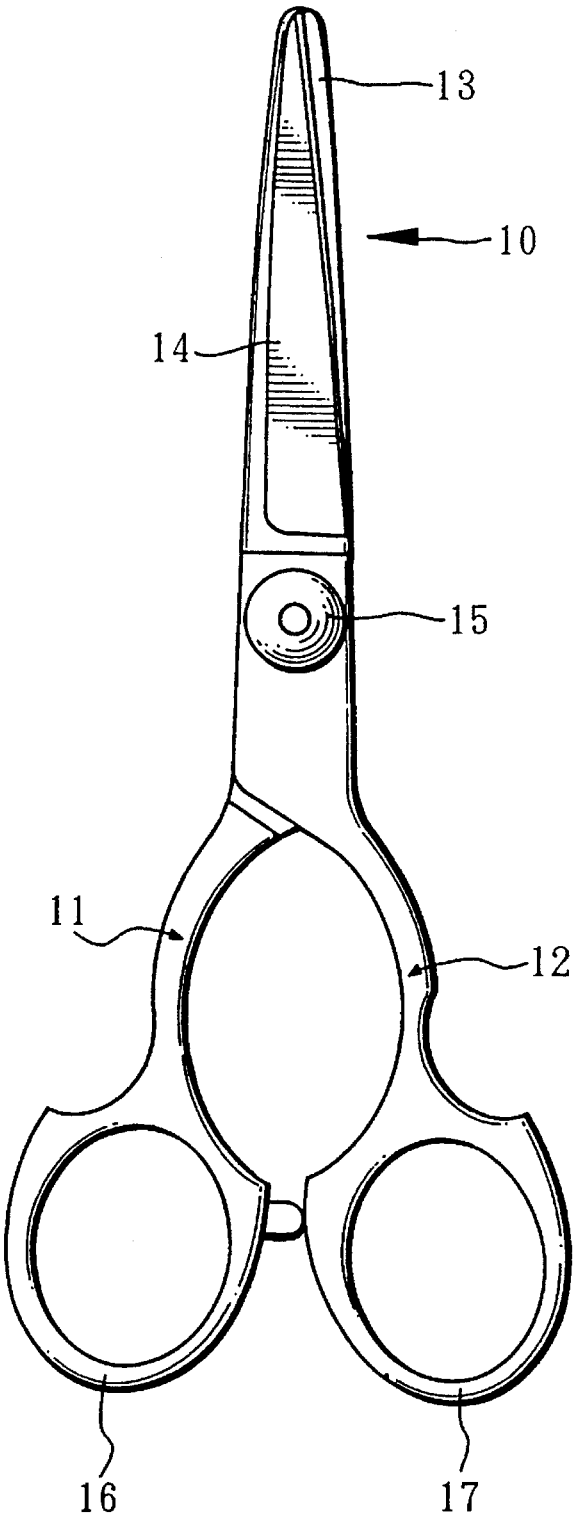
FIG. 1 is a plan view illustrating an embodiment of scissors according to the present invention.

A preferred embodiment of a scissor 10 includes a fixed blade 11 and a movable blade 12, each blade 11, 12 having a handle portion 16, 17 and a cutting portion 13, 14, each having a cutting edge, the blades pivotally joined by a screw 15. Each cutting portion 13, 14 is detachably secured to each handle portion 16, 17, respectively. The cutting portions 13, 14 have shanks (not shown) and the handle portions 16, 17 have grooves (not shown) into which the shanks fit to be held thereby. An example of a construction for holding cutting portions 13, 14 in handle portions 16, 17 is illustrated and discussed in U.S. Pat. No. 5,086,563, the disclosure of which is incorporated herein by reference.

When the cutting portions 13, 14 are to be replaced by new ones, the screw 15 is loosened and the cutting portions 13, 14 are detached from the handle portions 16, 17 after the two blades 11, 12 have been separated from each other. Shanks of new cutting portions are then inserted into the grooves of the handle portions 16, 17 and the screw 15 is fastened to join the two blades 11, 12, respectively.

In accordance with the invention, a ceramic coating is provided on the cutting edge surface of each cutting portion 13, 14 by vapor deposition, the coating being 100Å–5 μm in thickness. The color of the ceramic coating can be optionally selected depending upon a component of a reactant gas used in the vapor deposition process. The cutting portions have a length of 4.5 7 inches and are preferably made of a high quality stainless steel.

Working examples to produce the ceramic coating on the surface of the cutting edge are described hereinafter.

EXAMPLE 1

A cutting portion of a scissors blade of a stainless steel is set on a rotatable table within the interior of a vacuum chamber in which pressure is reduced to a degree of 0.8 Torr or less and a reactant gas of $SiH_4$—$NH_3(N_2)$ is introduced to perform a plasma excitation reaction.

An amorphous ceramic coating represented by $Si_3N_4$ (200Å in thickness) is produced on an outer surface of the cutting edge of the blade of stainless steel.

EXAMPLE 2

A cutting portion of a scissors blade of a stainless steel is disposed in a gas dispersion unit in which a reactant gas of $SiH_4$—$O_2$—$PH_3(B_2H_6)$ is introduced and heated under an atmospheric pressure. An amorphous ceramic coating including P and B is produced on the surface of the cutting edge of the blade.

EXAMPLE 3

A cutting portion of a scissors blade of a stainless steel is put in a chamber in which nitrogen gas is introduced and pressure therein is decreased to an extent of $5\times10^{-4}$ Torr or less. Titanium based alloy substrates to be deposited are evaporated in the chamber by heating and an amorphous ceramic coating containing Ti and TiN is produced on a surface of the cutting edge of the blade and has a thickness of 0.5 μm.

EXAMPLE 4

A cutting portion of a scissors blade of a stainless steel is placed in a reaction chamber in which pressure is less than $10^{-2}$ Torr and a high frequency energy of RF0.3–10 KW is applied to emit plasma of Al. Al-plasma is deposited to produce alumina coating on a surface of the cutting edge of the blade.

These cutting portions of the scissors blades treated by the above-mentioned processes have a long lasting sharpness and a long cutting life. Further, adoption of amorphous ceramic coating on the cutting edges of the blades makes it possible to provide the cutting blades with dazzling colors. These advantages will be obtained also by SiC based ceramic coating.

As many apparently widely different embodiments of the present invention can be made without departing from the spirit and scope thereof, it is to be understood that the invention is not limited to the specific embodiments thereof except as defined in the appended claims.

I claim:

1. Scissors comprising a pair of blades adapted to pivotally cooperate with each other, each blade comprising a handle portion and a cutting portion, each said cutting portion having a cutting edge integrally formed at one end thereof and being detachably secured at an opposite end to a handle portion, each of said cutting portions being made of metal, wherein the outer surface of the cutting portion of each blade including the cutting edge is coated with a colored ceramic coating having a thickness of from 100Å to 0.5 μm.

2. The scissors of claim 1, wherein the cutting portion is made of stainless steel.

3. The scissors of claim 2, wherein the colored ceramic coating is produced on the cutting portions of each blade by a chemical or physical vapor deposition process.

4. The scissors of claim 3, wherein the colored ceramic coating is of gold, pink, green or blue.

5. The scissors of claim 1, wherein the handle portion of each blade is also coated with the colored ceramic coating.

* * * * *